US011457697B1

(12) United States Patent
Joshi

(10) Patent No.: US 11,457,697 B1
(45) Date of Patent: Oct. 4, 2022

(54) BELT OR STRAP FASTENER

(71) Applicant: Shailendra Joshi, Ho Ho Kus, NJ (US)

(72) Inventor: Shailendra Joshi, Ho Ho Kus, NJ (US)

( * ) Notice: Subject to any disclaimer, the term of this patent is extended or adjusted under 35 U.S.C. 154(b) by 0 days.

(21) Appl. No.: 17/133,738

(22) Filed: Dec. 24, 2020

(51) Int. Cl.
*A44B 11/06* (2006.01)

(52) U.S. Cl.
CPC ..... *A44B 11/06* (2013.01)

(58) Field of Classification Search
CPC ..... A44B 11/06; A44B 11/16; A44B 11/02; A44B 11/22; Y10T 24/407; Y10T 24/4086; Y10T 24/4093; Y10T 24/4736
See application file for complete search history.

(56) References Cited

U.S. PATENT DOCUMENTS 1,350,207 A * 8/1920 Billings ..... A44B 11/06 24/318
1,535,617 A * 4/1925 Malouf ..... A41F 11/16 24/200
1,976,950 A * 10/1934 Livesay ..... A44B 11/12 24/191
2,129,872 A * 9/1938 Reiter ..... A44B 11/10 24/196
3,414,947 A * 12/1968 Holmberg ..... A44B 11/2557 24/196
2006/0282991 A1* 12/2006 Ross ..... A44B 11/2592 24/163 K
2015/0272281 A1* 10/2015 Xiao ..... A44B 11/16 297/468
2020/0281328 A1* 9/2020 Heinemark ..... A45F 5/021

* cited by examiner

*Primary Examiner* — Robert Sandy
*Assistant Examiner* — Rowland Do
(74) *Attorney, Agent, or Firm* — Gulf Coast Intellectual Property Group

(57) ABSTRACT

A fastener for a belt or strap that is configured to be operable with a single hand wherein the fastener includes a body having a first portion and a second portion. The body of the fastener is movable between a first position and a second position. In the first position the first portion and second portion are compressed against each other. In the second position the second portion is moved away from the first portion to create a void therebetween of suitable width to journal a portion of a strap or belt therethrough. A first arm member is secured between the first portion and second portion and is arcuate in shape. A second arm member, arcuate in shape, is secured between the first portion and second portion of the body. A gripping member is present on the first portion of the body.

6 Claims, 3 Drawing Sheets

BELT OR STRAP FASTENER

FIELD OF THE INVENTION

The present invention relates generally to securing mechanisms, more specifically but not by way of limitation, a fastener configured to assist in releasably securing a belt or strap wherein the fastener of the present invention includes two portions biased inwardly towards each other with at least one arm member so as to retain a section of the strap intermediate a void between the two portions.

BACKGROUND

Straps and belts are well known in the art. Both of the aforementioned have various applications and wide ranges of use. Belts are commonly worn as garment accessories wherein the belt is circumferentially disposed around a user's waist while being journaled through a portion of a garment such as but not limited to shorts or pants. The belt is adjusted in diameter and can be utilized to assist in securing of the garment to the user. Conventional belts employ a buckle fastener to secure to a desired length. These fasteners will often have a tang or protrusion that is operable to journal through an aperture present in the belt. Other buckle fasteners include a sliding biasing pin that will secure the a portion of the belt within the buckle.

Straps are available in various sizes and types and can be utilized in areas such as healthcare, cargo securing and other applications. In applications such as healthcare, nylon straps are utilized for tourniquets or other binding/securing applications. Many times straps in these applications do not employ buckle type fasteners and are often tied which results in twisting of the strap. This results in both discomfort to the patient and a potential loss of the desired secured position. Depending upon the application it can be cumbersome to secure a belt or strap efficiently. Additionally, it can be difficult to ensure no binding or twisting of a strap for certain applications.

It is intended within the scope of the present invention to provide a fastener that can be employed on various types of straps and belts wherein the fastener of the present invention can be operated by a user with one hand and further eliminate any twisting of a strap.

SUMMARY OF THE INVENTION

It is the object of the present invention to provide a fastener configured to be secured to a belt or strap so as to assist in securing of the belt or strap in a desired application wherein the fastener of the present invention includes a body manufactured from a durable rigid material such as but not limited to plastic or metal or a combination thereof.

Another object of the present invention is to provide a fastener for a belt or strap that is secured to one end thereof and is configured to have an additional portion journaled therethrough wherein the body includes a first portion and a second portion.

A further object of the present invention is to provide a fastener configured to be secured to a belt or strap so as to assist in securing of the belt or strap in a desired application wherein first portion and second portion of the body are movably coupled having a void therebetween.

Still another object of the present invention is to provide a fastener for a belt or strap that is secured to one end thereof and is configured to have an additional portion journaled therethrough wherein the body includes a first position and a second position and movement therebetween is in a linear opposing direction.

An additional object of the present invention is to provide a fastener configured to be secured to a belt or strap so as to assist in securing of the belt or strap in a desired application wherein the first portion and second portion of the body are movably coupled utilizing an upper arm member and a lower arm member.

Yet a further object of the present invention is to provide a fastener for a belt or strap that is secured to one end thereof and is configured to have an additional portion journaled therethrough wherein the upper arm member and the lower arm member are arcuate in shape.

Another object of the present invention is to provide a fastener configured to be secured to a belt or strap so as to assist in securing of the belt or strap in a desired application wherein the upper arm member and lower arm member apply a biasing force to maintain the body in its first position such that the first portion and second portion are biased against each other.

An alternate object of the present invention is to provide a fastener for a belt or strap that is secured to one end thereof and is configured to have an additional portion journaled therethrough wherein an inward force on the upper arm member and lower arm member transitions the body to it second position wherein a void is present between the first portion and second portion of the body.

An alternative objective of the present invention is to provide a fastener configured to be secured to a belt or strap so as to assist in securing of the belt or strap in a desired application wherein the first portion includes a leading edge having grip elements formed thereon.

Another object of the present invention is to provide a fastener for a belt or strap that is secured to one end thereof and is configured to have an additional portion journaled therethrough wherein the fastener of the present invention can be employed on belts or straps for various alternate applications.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
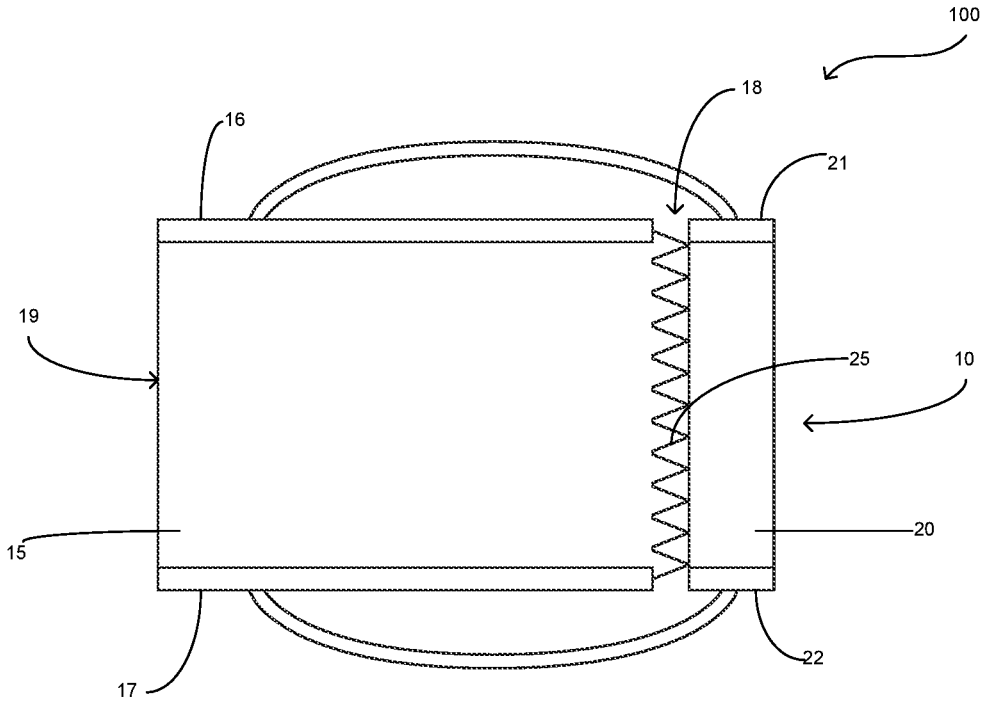
FIG. 1 is a is a front view of the body of the present invention in its first position.

References now to the drawings submitted herewith, wherein various elements depicted therein are not necessarily drawn to scale and wherein through the views and figures like elements are referenced with identical reference numerals, there is illustrated a belt and strap fastener 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Drawings submitted as a part hereof, the belt and strap fastener 100 includes a body 10 includes a first portion 15 and a second portion 20. It is contemplated within the scope of the present invention that the body 10 is manufactured from a durable rigid material such as but not limited to plastic or metal. The first portion 15 of the body 10 includes an upper edge 16 and lower edge 17. First portion 15 is further defined by a first end 18 and a second end 19. While the first portion 15 is illustrated herein as being rectangular in shape, it is contemplated within the scope of the present invention that the first portion 15 could be formed in alternate shapes and still achieve the objectives discussed herein.

The first end 18 of the first portion 15 includes gripping members 25 formed thereon wherein the gripping members 25 are intermediate the upper edge 16 and lower edge 17. The gripping members 25 are formed to assist in engagement and maintenance of the belt 90 when the body 10 is in its first position. While the gripping members 25 are illustrated herein in a toothed formation, it should be understood within the scope of the present invention that the gripping members 25 could be formed in alternate shapes and achieve the stated objective. Furthermore, while the gripping members 25 are illustrated as extending substantially the length of the first end 18, it is contemplated within the scope of the present invention that the gripping members 25 could be formed on only a portion of the first end 18 or be discrete formations distributed thereon.

The second portion 20 of the body 10 is movably coupled to the first portion 15. The second portion 20 of the body 10 includes an upper edge 21, lower edge 22, a first longitudinal edge 23 and a second longitudinal edge 24. While the second portion 20 is illustrated herein as being rectangular in shape, it is contemplated within the scope of the present invention that the second portion 20 could be provided in various alternate shapes and sizes and still achieve the desired objective discussed herein. The first longitudinal edge 23 is biased against the gripping members 25 in the first position of the body 10.

Figure 3:
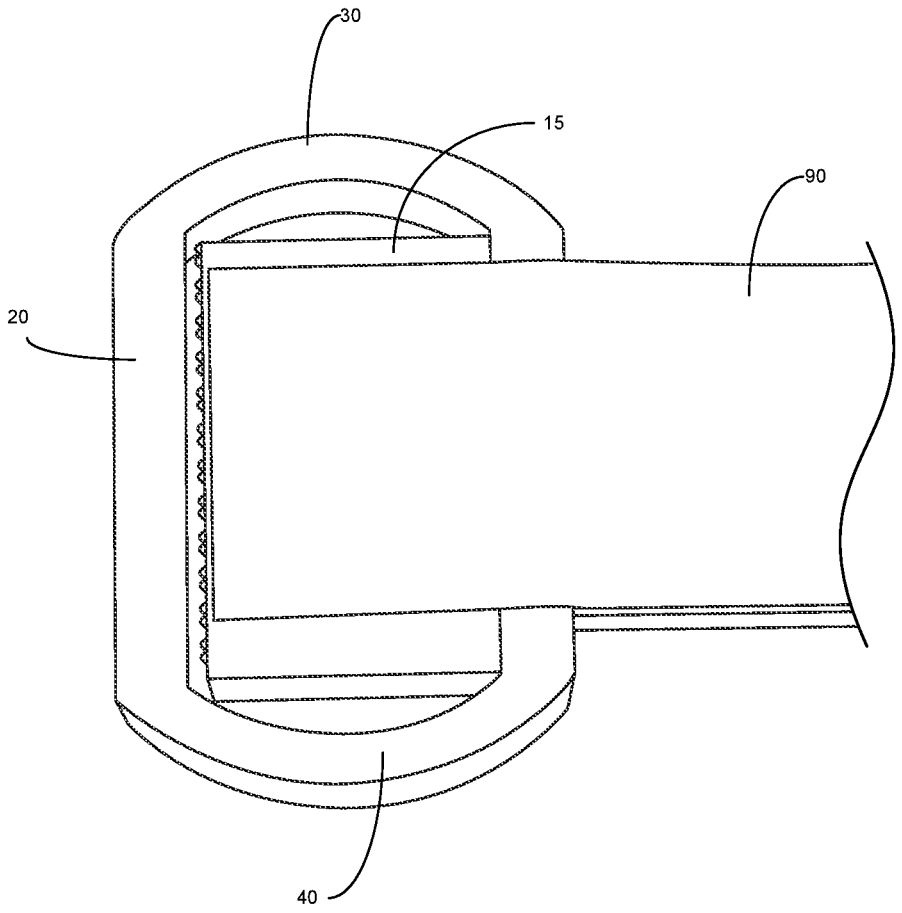
FIG. 3 is a perspective view of the present invention.
Figure 4:
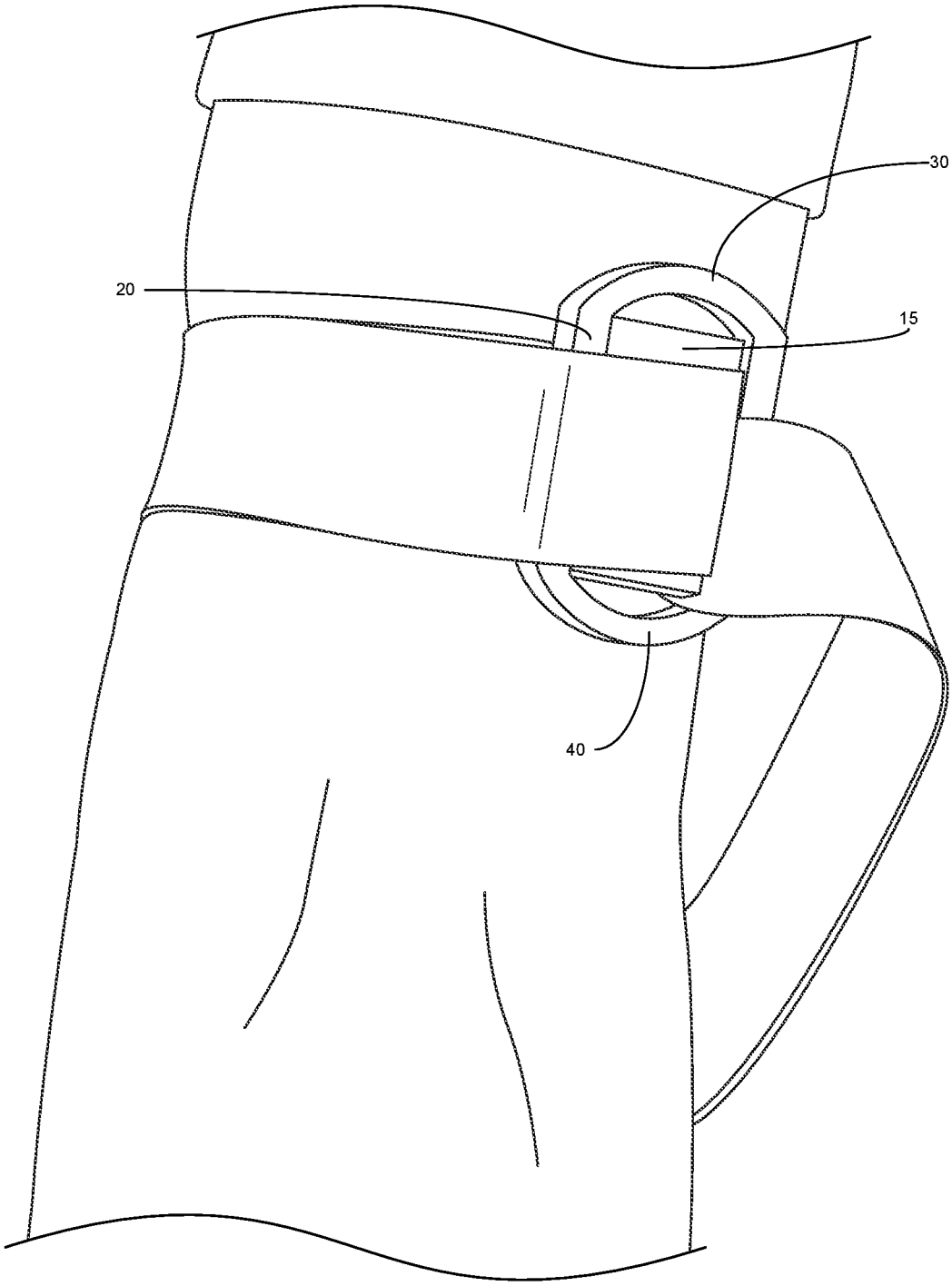
FIG. 4 is a perspective view of an exemplary application for the present invention.

The belt and strap fastener 100 further includes a first arm member 30 and a second arm member 40. The first arm member 30 includes a first end 31 and a second end 32. The first end 31 is secured to the upper edge 16 of the first portion 15 utilizing suitable durable techniques. The second end 32 of the first arm member 30 is secured to the upper edge 21 of the second portion 20 utilizing suitable durable techniques. As is illustrated herein in FIGS. 3 and 4, the first arm member 30 can further be manufactured such that the first arm member 30 is contiguously formed with the first portion 15 and second portion 20. The first arm member 30 is arcuate in form and manufactured from a material wherein the arcuate form creates a bias force such that the first arm member 30 compresses the first portion 15 and second portion 20 against each other and as such functions to maintain position of the belt 90 ensuing the belt being circumferentially disposed around a desired object.

The second arm member 40 is identically constructed as the first arm member 30. The second arm member 40 includes a first end 41 and a second end 42. The first end 41 is secured to the lower edge 17 of the first portion 15 utilizing suitable durable techniques. The second end 42 of the second arm member 40 is secured to the lower edge 22 of the second portion 20 utilizing suitable durable techniques. As is illustrated herein in FIGS. 3 and 4, the second arm member 40 can further be manufactured such that the second arm member 40 is contiguously formed with the first portion 15 and second portion 20. As with the first arm member 30, the second arm member 40 is arcuate in form and manufactured from a material wherein the arcuate form creates a bias force such that the second arm member 40 compresses the first portion 15 and second portion 20 against each other and as such functions to maintain position of the belt 90 ensuing the belt being circumferentially disposed around a desired object. The first arm member 30 and second arm member 40 have equivalent sizes and radiuses that are generally equal so as to promote a normalized and equal force across the width of the body 10 in between the first portion 15 and second portion 20.

Figure 2:
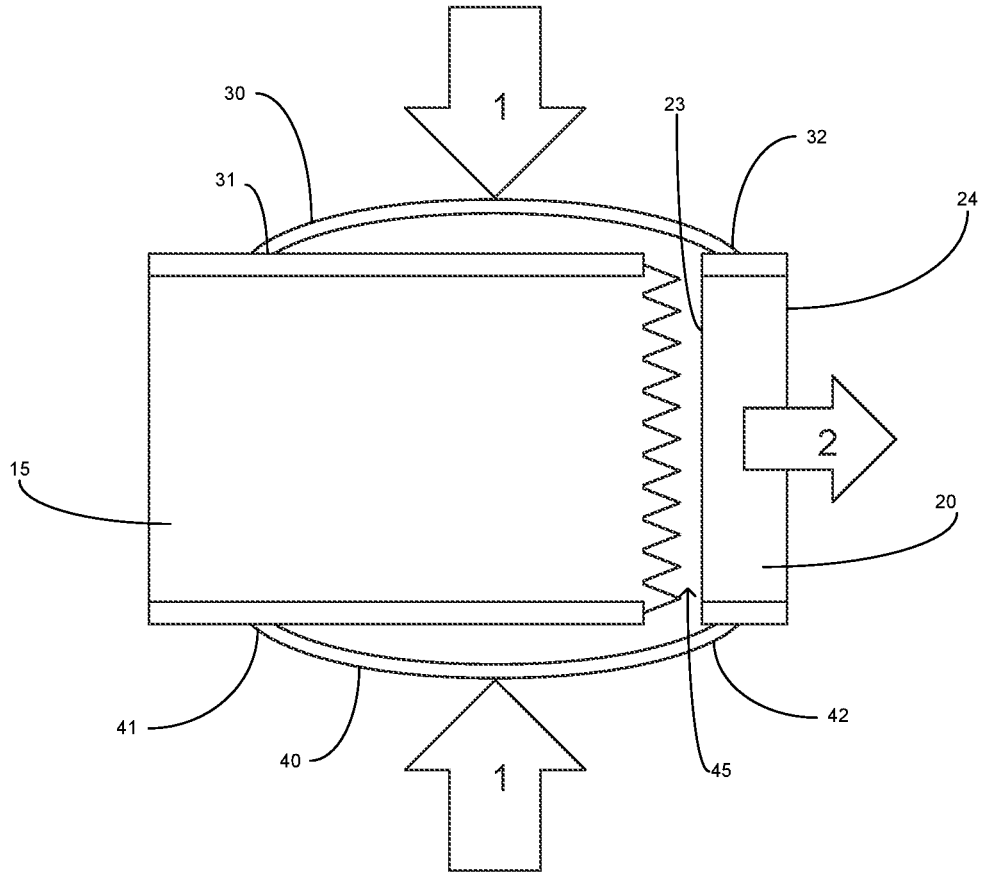
FIG. 2 is a front view of the body of the present invention in its second position.

As is illustrated in FIG. 2 submitted herewith, exemplary directional arrows labeled with numerical value of one and two demonstrate the movement and operation of the body 10 wherein the second portion 20 moves away from the first portion 15 when a downward force on the first arm member 30 and second arm member 40 is exerted. Upon a downward force being applied to the first arm member 30 and second arm member 40 the void 45 intermediate the first portion 15 and second portion 20 is increased so as to allow belt 90 to slide therethrough with no resistance in order to provide adjustment thereof. Ensuing release of the first arm member 30 and second arm member 40 the second portion 20 will be forced back into its position such that the second portion 20 is biased against the first portion 15. The equivalent length of the first arm member 30 and second arm member 40 provide a normalized force distribution between the first portion 15 and second portion 20. It is contemplated within the scope of the present invention that the first arm member 30 and second arm member 40 could be manufactured from alternate materials, alternate lengths and alternate radiuses in order to affect the amount of force present between the first portion 15 and second portion 20. Additionally, while the belt and strap fastener 100 is illustrated and discussed herein having a first arm member 30 and a second arm member 40, it is contemplated within the scope of the present invention that the belt and strap fastener 100 could include a single arm member operably coupling the first portion 15 and second portion 20 in order to achieve the desired functionality discussed herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A fastener for a strap or belt wherein the fastener is movable between a first position and a second position utilizing a single hand of a user to provide adjust and tightening of the strap or belt wherein the fastener comprises:

a body, said body having a first portion and a second portion, said first portion of said body having an upper edge and a lower edge, said first portion of said body having a first end and a second end, said first end having a gripping member formed thereon, said gripping member extending substantially along the first end intermediate said upper edge and said lower edge, said second portion of said body having an upper edge and a lower edge, said second portion having a first longitudinal edge and a second longitudinal edge, said first portion and said second portion being movably coupled;

a first arm member, said first arm member being arcuate in form, said first arm member having a first end and a second end, said first end of said first arm member being secured to said upper edge of said first portion of said body, said second end of said first arm member being secured to said upper edge of said second portion of said body, said first arm member having a midpoint between said first end and said second end of said first arm member;

a second arm member, said second arm member being arcuate in form, said second arm member having a first end and a second end, said first end of said second arm member being secured to said lower edge of said first portion of said body, said second end of said second arm member being secured to said lower edge of said second portion, said second arm member having a midpoint between said first end and said second end of said second arm member; and wherein a force is applied to said first arm member and said second arm member proximate the midpoints thereof in order to move said first portion of said body away from said second portion of said body.

2. The fastener for a belt or strap as recited in claim 1, wherein said first arm member and said second arm member have an equivalent radius.

3. The fastener for a belt or strap as recited in claim 2, wherein in said first position said first portion and said second portion of said body are adjacent.

4. The fastener for a belt or strap as recited in claim 3, wherein said first arm member and said second arm member are equivalent in length.

5. The fastener for a belt or strap as recited in claim 4, wherein in said second position said second portion of said body is moved away from said first portion of said body so as to create a void therebetween.

6. The fastener for a belt or strap as recited in claim 5, wherein said gripping member is a tooth shape formation.

* * * * *